US011643731B2

(12) United States Patent
Dahlenburg et al.

(10) Patent No.: US 11,643,731 B2
(45) Date of Patent: May 9, 2023

(54) METHOD FOR NICKEL-FREE PHOSPHATING METAL SURFACES

(71) Applicant: Chemetall GmbH, Frankfurt (DE)

(72) Inventors: Olaf Dahlenburg, Frankfurt am Main (DE); Thomas Kolberg, Frankfurt am Main (DE); Lisa Seider, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 489 days.

(21) Appl. No.: 16/640,581

(22) PCT Filed: Aug. 28, 2018

(86) PCT No.: PCT/EP2018/073056
§ 371 (c)(1),
(2) Date: Feb. 20, 2020

(87) PCT Pub. No.: WO2019/042951
PCT Pub. Date: Mar. 7, 2019

(65) Prior Publication Data

US 2020/0199758 A1 Jun. 25, 2020

(30) Foreign Application Priority Data

Aug. 31, 2017 (EP) ..... 17188783

(51) Int. Cl.

| | |
|---|---|
| ***C11D 7/14*** | (2006.01) |
| ***C11D 7/26*** | (2006.01) |
| ***C11D 11/00*** | (2006.01) |
| ***C23C 22/36*** | (2006.01) |
| ***C11D 7/10*** | (2006.01) |
| ***C23C 22/78*** | (2006.01) |
| ***C23G 1/18*** | (2006.01) |

(52) U.S. Cl.
CPC ..... *C23C 22/365* (2013.01); *C11D 7/105* (2013.01); *C11D 7/14* (2013.01); *C11D 7/265* (2013.01); *C11D 11/0029* (2013.01); *C11D 11/0041* (2013.01); *C23C 22/78* (2013.01); *C23G 1/18* (2013.01)

(58) Field of Classification Search
CPC ..... C11D 7/105; C11D 11/0029; C11D 7/265; C11D 11/004
See application file for complete search history.

(56) References Cited

U.S. PATENT DOCUMENTS

| | | | | | |
|---|---|---|---|---|---|
| 4,680,064 | A * | 7/1987 | Portz | C23C 22/17 | 544/2 |
| 4,867,853 | A * | 9/1989 | Hauffe | C23G 1/14 | 106/14.14 |
| 5,160,551 | A * | 11/1992 | Rein | C23C 22/80 | 148/262 |
| 5,520,841 | A * | 5/1996 | Block | C23G 1/14 | 510/435 |
| 5,868,873 | A * | 2/1999 | Brown | C23C 22/78 | 423/306 |
| 2002/0185199 | A1* | 12/2002 | Myers | A01N 59/16 | 148/537 |
| 2004/0129346 | A1* | 7/2004 | Koi | C23C 22/186 | 148/262 |
| 2018/0112313 | A1* | 4/2018 | Dahlenburg | C23C 22/78 | |
| 2018/0112314 | A1 | 4/2018 | Dahlenburg et al. | | |
| 2020/0199758 | A1* | 6/2020 | Dahlenburg | C11D 7/14 | |

FOREIGN PATENT DOCUMENTS

| | | | | |
|---|---|---|---|---|
| CN | 105369271 | A * | 3/2016 | C23C 22/44 |
| CN | 105369271 | A | 3/2016 | |
| DE | 1074358 | B | 1/1960 | |
| DE | 19854431 | A1 | 5/2000 | |
| DE | 102016205815 | A1 | 10/2016 | |
| EP | 0264151 | A1 | 4/1988 | |
| WO | 9323522 | A1 | 11/1993 | |
| WO | 9508007 | A1 | 3/1995 | |
| WO | 02070782 | A2 | 9/2002 | |
| WO | WO-02070781 | A2 * | 9/2002 | C23C 22/182 |
| WO | 2017202891 | A1 | 11/2017 | |

OTHER PUBLICATIONS

CN-105369271-A. an English Translation. 2022 (Year: 2022).*
Dr. Werner Rausch, "Chapter 8: Analytical Control of Process Chemicals", The Phosphating of Metals, 1990, pp. 327-334.
European Search Report for EP Patent Application No. 17188783.9, dated Feb. 27, 2018, 5 pages.
English translation of International Search Report for International Application No. PCT/EP2018/073056, dated Oct. 25, 2018, 4 pages.

* cited by examiner

*Primary Examiner* — Liam J Heincer
*Assistant Examiner* — M. Reza Asdjodi
(74) *Attorney, Agent, or Firm* — Armstrong Teasdale LLP

(57) ABSTRACT

The present invention relates to a method for substantially nickel-free phosphating of a metallic surface, wherein a metallic surface is treated one after the other with the following compositions:

i) with an alkaline, aqueous cleaner composition which comprises at least one water-soluble silicate, and ii) with an acidic, aqueous, substantially nickel-free phosphating composition which comprises zinc ions, manganese ions and phosphate ions.

The invention also relates to the above cleaner composition itself and also to a metallic surface phosphate-coated by the above method, and to the use of said surface.

16 Claims, No Drawings

METHOD FOR NICKEL-FREE PHOSPHATING METAL SURFACES

CROSS-REFERENCE TO RELATED APPLICATIONS

This application is a U.S. National Phase Application of PCT/EP2018/073056, filed Aug. 28, 2018, which claims the benefit of priority to EP Application No. 17188783.9, filed Aug. 31, 2017, the contents of which are hereby expressly incorporated by reference in their entirety.

The present invention relates to a method for substantially nickel-free phosphating of a metallic surface using a specific cleaner composition, to this cleaner composition itself, and also to a metallic surface phosphate-coated by the method, and to the use of said surface.

Phosphate coatings on metallic surfaces are known from the prior art. Such coatings serve to prevent corrosion of the metallic surfaces and also, furthermore, as adhesion promoters for subsequent coating films.

Such phosphate coatings are employed in particular in the sector of the automobile industry and also of general industry.

The subsequent coating films, as well as powder coatings and wet paints, are, in particular, cathodically deposited electrocoat (CEC) materials. Since the deposition of CEC requires a flow of current between metallic surface and treatment bath, it is important to set a defined electrical conductivity in the phosphate coating in order to ensure efficient and uniform deposition.

Phosphate coatings, therefore, are customarily applied using a nickel-containing phosphating solution. The nickel deposited in this process, elementally or as an alloy constituent, e.g., Zn/Ni, provides appropriate conductivity of the coating in the course of the subsequent electrocoating procedure.

On account of their high toxicity and environmental harmfulness, however, nickel ions are no longer a desirable constituent of treatment solutions, and ought therefore as far as possible to be avoided or at least reduced in terms of their amount.

The use of nickel-free or low-nickel phosphating solutions is indeed known in principle. It is limited, however, to particular substrates such as steel.

The stated nickel-free or low-nickel systems, moreover, may result in poor corrosion protection values and coating adhesion values under prevailing CEC deposition conditions, owing to a nonideal substrate surface.

It was an object of the present invention, therefore, to provide a method with which metallic surfaces can be subjected to substantially nickel-free phosphating, where the aforementioned disadvantages of the prior art are avoided.

This object is achieved by a method according to claim 1, a phosphating composition according to claim 12, and a phosphate-coated metallic surface according to claim 14.

With the method of the invention for substantially nickel-free phosphating of a metallic surface, a metallic surface is treated one after the other with the following compositions:

i) with an alkaline, aqueous cleaner composition which comprises at least one water-soluble silicate, and then
ii) with an acidic, aqueous, substantially nickel-free phosphating composition which comprises zinc ions, manganese ions and phosphate ions.

Definitions

The method of the invention can be used to treat either an uncoated metallic surface or else a metallic surface which has already been conversion coated. Reference below to a "metallic surface" is therefore always to be taken as also including an already conversion-coated metallic surface. Preferably, however, the metallic surface in question is uncoated.

An "aqueous composition" for the purposes of the present invention is a composition which comprises at least partly, preferably predominantly, i.e., to an extent of more than 50 wt %, water as its solvent/dispersion medium. In addition to dissolved constituents, it may also comprise coarsely disperse constituents. It may therefore, for example, be an emulsion. Preferably, however, it is a solution, in other words a composition comprising no coarsely dispersed constituents.

Reference below to a "water-soluble silicate" is to a silicate which at 25° C. has a water solubility (in fully demineralized water) of at least 1 mg/l, preferably of at least 10 mg/l, more preferably of at least 100 mg/l, more preferably of at least 1 g/l, more preferably of at least 10 g/l, more preferably of at least 100 g/l, more preferably of at least 200 g/l, more preferably of at least 300 g/l and very preferably of at least 350 g/l. The silicate may also be in the form of a colloidal solution.

Where a composition comprises less than 0.3 g/l of nickel ions, it is considered for the purposes of the present invention to be "substantially nickel-free". The phosphating composition preferably comprises less than 0.1 g/l and more preferably less than 0.01 g/l of nickel ions.

For the purposes of the present invention, "phosphate ions" also refers to hydrogen phosphate, dihydrogen phosphate and phosphoric acid. Moreover, the intention is to include pyrophosphoric acid and polyphosphoric acid and all of their partially and fully deprotonated forms.

A "metal ion" for the purposes of the present invention is alternatively a metal cation, a complex metal cation or a complex metal anion.

The metallic surface preferably comprises steel, a steel alloy, a hot-dip galvanized system, an electrolytically galvanized system, a zinc alloy such as Zn/Fe or Zn/Mg, aluminum or an aluminum alloy. In the case of the hot-dip galvanized and electrolytically galvanized systems, they are in each case more particularly a system of this kind on steel. The metallic surface more particularly is at least partially galvanized.

The method of the invention is especially suitable for multimetal applications, particularly for metallic surfaces which as well as a galvanized system on steel, preferably a hot-dip galvanized system and an electrolytically galvanized system, comprise aluminum and/or an aluminum alloy, preferably an aluminum alloy.

Prior to the treatment with the acidic, aqueous, substantially nickel-free phosphating composition (step ii), the metallic surface in the invention is first cleaned in an alkaline, aqueous cleaner composition (step i), and more particularly degreased. For this purpose, optionally, it is also possible additionally to use an acidic or neutral pickling composition.

The cleaner composition in this case may be obtained from a concentrate by dilution with a suitable solvent, preferably with water, preferably by a factor of between 1.5 and 1000, more preferably between 50 and 200, and, where necessary, addition of a pH-modifying substance.

The effect of the at least one water-soluble silicate in the cleaner composition is to improve the cleaning effect and to reduce the pickling attack in the cleaning bath (inhibiting action).

The at least one water-soluble silicate here comprises preferably at least one waterglass, more particularly a lithium waterglass, a sodium waterglass and/or a potassium waterglass, more preferably a sodium waterglass and/or a potassium waterglass, and/or at least one metasilicate such as, for example, disodium metasilicate ($Na_2SiO_3$).

With particular preference the at least one water-soluble silicate comprises a sodium waterglass or a potassium waterglass.

The sodium waterglass is preferably one having a molar $Na_2O:SiO_2$ ratio in the range from 1 to 4. The potassium waterglass is likewise preferably one having a molar $K_2O:SiO_2$ ratio in the range from 1 to 4.

The at least one water-soluble silicate is present preferably in a total concentration in the range from 0.01 to 15 g/l, more preferably from 0.2 to 13 g/l and very preferably from 0.5 to 10 g/l.

The cleaner composition may, besides the at least one water-soluble silicate, comprise at least one cationic, nonionic and/or anionic surfactant and/or other additions, especially complexing agents, oxidizing agents, oils and/or auxiliaries such as, for example, solubilizers, borate and/or carbonate.

The addition of at least one complexing agent and/or at least one oxidizing agent has proven advantageous in respect of the corrosion protection and coating adhesion values achieved, and is therefore preferred.

The effect of complexing agents in the cleaner composition is to bring about complexing of water hardness and dissolved cations, which are present in solution or go into solution in the cleaner bath as a result of the pickling attack.

Preferred complexing agents here are, on the one hand, phosphorus-containing complexing agents.

These are more particularly phosphate-based complexing agents—preferably in turn condensed phosphates such as, for example, pyrophosphates, tripolyphosphates and other polyphosphates—and also phosphonic acids such as, for example, 1-hydroxyethane-(1,1-diphosphonic acid) (HEDP) and salts thereof.

The phosphorus-containing, especially phosphate-based, complexing agents are present preferably in a total concentration in the range from 0.01 to 15 g/l, more preferably from 0.05 to 13 g/l and very preferably from 0.1 to 10 g/l (calculated as tetrapotassium pyrophosphate).

Preferred complexing agents are, on the other hand, hydroxycarboxylic acids, which have at least one hydroxyl group and also at least one carboxyl group, and salts thereof, especially sugar acids and salts thereof, more preferably heptonate and gluconate. Very particular preference is given to gluconate. Such complexing agents are present preferably in a total concentration in the range from 0.01 to 6 g/l, more preferably from 0.05 to 5 g/l and very preferably from 0.1 to 4 g/l (calculated as sodium gluconate).

According to one particularly preferred embodiment, the cleaner composition comprises at least one phosphorus-containing complexing agent, more particularly a pyrophosphate and/or a tripolyphosphate, and at least one hydroxycarboxylic acid or salt thereof, more particularly gluconate. Especially preferred combinations here are as follows:

i) tetrapotassium pyrophosphate and gluconate, ii) pentasodium tripolyphosphate and gluconate.

A preferred oxidizing agent is nitrite. The oxidizing agents are present preferably in a total concentration in the range from 10 to 100 mg/l, more preferably from 20 to 50 mg/l (calculated as nitrite).

There are preferably no iron ions, more particularly no iron(III) ions, added to the cleaner composition. Any iron ions that are present in the cleaning bath in this case originate exclusively from the treated metallic surface.

To adjust the alkalinity of the cleaner composition it is possible to use on the one hand, in particular, sodium hydroxide, potassium hydroxide, caustic soda or caustic potash and on the other hand, in particular, phosphoric acid.

The pH of the cleaner composition in this case is preferably in the range from 9.5 to 13, more particularly in the range from 10.5 to 12, more preferably in the range from 10.7 to 12.0, more preferably from 11.0 to 12.0, more preferably from 11.3 to 12.0 and very preferably in the range from 11.5 to 12.0.

The cleaner composition preferably has a temperature in the range from 35 to 70, more preferably from 40 to 65 and very preferably from 45 to 60° C. The metallic surface is treated with the cleaner composition preferably for 30 to 600, more preferably for 60 to 480 and very preferably for 90 to 360 seconds, preferably by means of dipping or spraying, or of the combination of both.

According to one preferred embodiment, the metallic surface is first sprayed with the cleaner composition for 30 to 90 seconds and subsequently immersed therein for 100 to 300 seconds.

After the cleaning/pickling and before the treatment of the metallic surface with the phosphating composition, the metallic surface is advantageously also at least rinsed with water, in which case the water may optionally have been admixed as well with a water-dissolved additive such as a nitrite or surfactant, for example.

Before the treatment of the metallic surface with the phosphating composition it is advantageous, moreover, to treat the metallic surface additionally with an activating composition. The purpose of the activating composition is to deposit a multiplicity of ultrafine phosphate particles as seed crystals on the metallic surface. These crystals help to form a phosphate layer, more particularly a crystalline phosphate layer, having an extremely high number of densely disposed, fine phosphate crystals, or a largely impervious phosphate layer, in the subsequent method step, in contact with the phosphating composition—preferably without rinsing in-between.

Activating compositions contemplated in this case include, in particular, alkaline compositions based on titanium phosphate or zinc phosphate.

It may, however, also be advantageous to add activating agents, especially titanium phosphate or zinc phosphate, to the cleaning composition itself—in other words, to carry out cleaning and activation in one step.

The acidic, aqueous, substantially nickel-free phosphating composition comprises zinc ions, manganese ions and phosphate ions.

The phosphating composition here may be obtained from a concentrate by dilution with a suitable solvent, preferably with water, by a factor of between 1.5 and 100, preferably between 5 and 50, and, where necessary, addition of a pH-modifying substance.

The phosphating composition preferably comprises the following components in the following preferred and more preferred concentration ranges:

| | | |
|---|---|---|
| Zn | 0.3 to 3.0 g/l | 0.5 to 2.0 g/l |
| Mn | 0.3 to 2.0 g/l | 0.5 to 1.5 g/l |
| Phosphate (calculated as $P_2O_5$) | 8 to 25 g/l | 10 to 18 g/l |
| free fluoride | 30 to 250 mg/l | 50 to 180 mg/l |
| complex fluoride (calculated, e.g., as $SiF_6^{2-}$ and/or $BF_4^-$) | 0 to 5 g/l | 0.5 to 3 g/l |

With regard to the manganese ions, however, a concentration in the range from 0.3 to 2.5 g/l has already proven advantageous, and, with regard to the free fluoride, a concentration in the range from 10 to 250 mg/l.

The complex fluoride is preferably tetrafluoroborate ($BF_4^-$) and/or hexafluorosilicate ($SiF_6^{2-}$).

Particularly in the treatment of aluminum and/or galvanized material, the presence in the phosphating composition of complex fluoride and also simple fluoride, sodium fluoride for example, is an advantage.

$Al^{3+}$ in phosphating systems is a bath poison and may be removed from the system by complexing with fluoride, in the form of cryolite, for example. Complex fluorides are added to the bath as "fluoride buffers", since otherwise the fluoride content would rapidly drop and coating would no longer take place. Fluoride, then, supports the formation of the phosphate layer and consequently leads indirectly to an improvement in coating adhesion and corrosion protection, as well. On galvanized material, furthermore, complex fluoride helps to prevent defects such as specks.

Particularly in the case of the treatment of aluminum, it is advantageous, moreover, if the phosphating composition has a content of iron(III) ions. The iron(III) ions are added preferably to the phosphating composition. Preference is given in this case to an amount of added iron(III) ions in the range from 0.001 to 0.2 g/l, more preferably from 0.001 to 0.1 g/l, more preferably from 0.005 to 0.1 g/l, very preferably from 0.005 to 0.05 g/l and especially preferably from 0.005 to 0.02 g/l.

The phosphating composition further preferably comprises at least one accelerator selected from the group consisting of the following compounds in the following preferred and more preferred concentration ranges:

| | | |
|---|---|---|
| Nitroguanidine | 0.2 to 3.0 g/l | 0.2 to 1.55 g/l |
| $H_2O_2$ | 10 to 100 mg/l | 15 to 50 mg/l |
| Nitroguanidine/$H_2O_2$ | 0.2 to 2.0 g/l 10 to 50 mg/l | 0.2 to 1.5 g/l 15 to 30 mg/l |
| Nitrite | 30 to 300 mg/l | 90 to 150 mg/l |
| Hydroxylamine | 0.1 to 5 g/l | 0.4 to 3 g/l |

With regard to the nitroguanidine, however, a concentration in the range from 0.1 to 3.0 g/l has already proven advantageous, and, with regard to the $H_2O_2$, a concentration in the range from 5 to 200 mg/l.

Very preferably the at least one accelerator is $H_2O_2$.

The phosphating composition, however, preferably comprises less than 1 g/l, more preferably less than 0.5 g/l, very preferably less than 0.2 g/l and especially preferably less than 0.1 g/l of nitrate.

The reason for this is that in the case of a galvanized surface, in particular, the nitrate in the phosphating composition causes an additional acceleration in the coat-forming reaction, resulting in lower coat weights but in particular reducing the incorporation of the manganese into the crystal. If the manganese content of the phosphate coating is too low, however, its alkali resistance suffers.

The alkali resistance in turn plays a critical part during subsequent cathodic electrocoat deposition. In this process, electrolytic dissociation of water occurs at the substrate surface: hydroxide ions are formed. As a result, the pH at the substrate interface goes up. It is indeed only by this means that the electrocoat material is able to agglomerate and be deposited. However, the elevated pH may also damage the crystalline phosphate layer.

The phosphating composition preferably has a temperature in the range from 30 to 55° C.

The phosphating composition may be characterized, furthermore, by the following preferred and more preferred parameter ranges:

| | | |
|---|---|---|
| FA | 0.3 to 2.0 | 0.7 to 1.6 |
| FA (dil.) | 0.5 to 8 | 1 to 6 |
| TAF | 12 to 28 | 22 to 26 |
| TA | 12 to 45 | 18 to 35 |
| A value | 0.01 to 0.2 | 0.03 to 0.15 |
| Temperature | 30 to 50° C. | 35 to 45° C. |

With regard to the FA parameter, however, a value in the range from 0.2 to 2.5 has already proven advantageous, and with regard to the temperature a value in the range from 30 to 55° C.

In this listing, "FA" stands for Free Acid, "FA (dil.)" stands for Free Acid (diluted), "TAF" stands for Total Acid, Fischer, "TA" stands for Total Acid, and "A Value" stands for Acid Value.

Ascertaining these parameters is carried out as part of the analytic checking of the phosphating chemicals and serves for ongoing monitoring of the working phosphating bath (cf. W. Rausch "Die Phosphatierung von Metallen", Eugen G. Leuze Verlag, 3rd edition, 2005, chapter 8, p. 332 ff.):

Free Acid (FA):

(See W. Rausch "Die Phosphatierung von Metallen", Eugen G. Leuze Verlag, 3rd edition, 2005, section 8.1, pp. 333-334)

For determination of the Free Acid, 10 ml of the phosphating composition are pipetted into a suitable vessel, such as a 300 ml Erlenmeyer flask. If the phosphating composition comprises complex fluorides, an additional 2-3 g of potassium chloride are added to the sample. Titration then takes place, using a pH meter and an electrode, with 0.1 M NaOH to a pH of 3.6. The quantity of 0.1 M NaOH consumed in this titration, in ml per 10 ml of the phosphating composition, gives the value of the Free Acid (FA) in points.

Free Acid (Diluted) (FA (Dil.)):

(See W. Rausch "Die Phosphatierung von Metallen", Eugen G. Leuze Verlag, 3rd edition, 2005, section 8.1, pp. 333-334)

For determination of the Free Acid (diluted), 10 ml of the phosphating composition are pipetted into a suitable vessel, such as a 300 ml Erlenmeyer flask. 150 ml of fully demineralized water are then added. Using a pH meter and an electrode, titration takes place with 0.1 M NaOH to a pH of 4.7. The quantity of 0.1 M NaOH consumed in this titration, in ml per 10 ml of the diluted phosphating composition, gives the value of the Free Acid (diluted) (FA (dil.)) in points. From the difference relative to the Free Acid (FA) it is possible to ascertain the amount of complex fluoride. If this difference is multiplied by a factor of 0.36, the result is the amount of complex fluoride as $SiF_6^{2-}$ in g/l.

Total Acid, Fischer (TAF):

(See W. Rausch "Die Phosphatierung von Metallen", Eugen G. Leuze Verlag, 3rd edition, 2005, section 8.2, pp. 334-336)

Following determination of the Free Acid (diluted), the diluted phosphating composition, following addition of potassium oxalate solution, is titrated, using a pH meter and an electrode, with 0.1 M NaOH to a pH of 8.9. The consumption of 0.1 M NaOH in this procedure, in ml per 10 ml of the diluted phosphating composition, gives the Total Acid, Fischer (TAF) in points. If this value is multiplied by 0.71, the result is the total amount of phosphate ions calculated as $P_2O_5$.

Total Acid (TA):

(See W. Rausch "Die Phosphatierung von Metallen", Eugen G. Leuze Verlag, 3rd edition, 2005, section 8.3, pp. 336-338)

The Total Acid (TA) is the sum of the divalent cations present and also free and bonded phosphoric acids (the latter being phosphates). It is determined by the consumption of 0.1 M NaOH, using a pH meter and an electrode. For this purpose, 10 ml of the phosphating composition are pipetted into a suitable vessel, such as a 300 ml Erlenmeyer flask, and diluted with 25 ml of fully demineralized water. This is followed by titration with 0.1 M NaOH to a pH of 9. The consumption during this procedure, in ml per 10 ml of the diluted phosphating composition, corresponds to the points number of the Total Acid (TA).

Acid Value (A Value):

(See W. Rausch "Die Phosphatierung von Metallen", Eugen G. Leuze Verlag, 3rd edition, 2005, section 8.4, p. 338)

The Acid Value (A Value) represents the ratio FA:TAF and is obtained by dividing the value for the Free Acid (FA) by the value for the Total Acid, Fischer (TAF).

The further improvement in the coating adhesion, especially on hot-dip galvanized surfaces, as a result of the setting of an acid value in the range from 0.03 to 0.065, more particularly in the range from 0.04 to 0.06, was surprising.

It has surprisingly emerged that, particularly in the case of steel or a hot-dip galvanized system as the metallic surface, a phosphating composition temperature of less than 45° C., preferably in the range between 35 and 45° C., leads to further-improved corrosion and coating adhesion values.

The metallic surface is treated with the phosphating composition preferably for 30 to 480, more preferably for 60 to 300 and very preferably for 90 to 240 seconds, preferably by means of dipping or spraying.

The treatment of the metallic surface with the phosphating composition produces the following preferred and more preferred zinc phosphate coat weights on the metallic surface, depending on the surface treated (determined by x-ray fluorescence analysis (XRF)):

| Surface treated | Zinc phosphate coat weight ($g/m^2$) | |
|---|---|---|
| Steel | 0.5 to 6 | 1 to 5 |
| Hot-dip galvanized system | 1.0 to 6 | 1.5 to 5 |
| Electrolytically galvanized system | 1.0 to 6 | 1.5 to 5 |
| Aluminum | 0.5 to 6 | 1 to 5 |

After the treatment with the phosphating composition, the metallic surface is preferably rinsed, more preferably with fully demineralized water or city water.

The metallic surface already treated with the phosphating composition, and therefore phosphate-coated, is advantageously treated further with an aqueous after-rinse composition. In that case the metallic surface is optionally dried before the treatment with the after-rinse composition.

The after-rinse composition here may be obtained from a concentrate by dilution with a suitable solvent, preferably with water, by a factor of between 1.5 and 1000, preferably between 5 and 700, and, where necessary, addition of a pH-modifying substance.

The treatment with the after-rinse composition allows the electrical conductivity of the phosphate-coated metal surface to be adjusted in a targeted way, through generation of defined pores in the phosphate layer. In that case the conductivity may be greater than, the same or less than that of a corresponding metal surface provided with a nickel-containing phosphate coating.

The adjusted electrical conductivity of the phosphate-coated metal surface may be influenced here via the variation in the concentration of a given metal ion and/or polymer in the after-rinse composition.

According to one embodiment, the after-rinse composition comprises at least one kind of metal ions selected from the group consisting of the ions of the following metals in the following preferred, more preferred and very preferred concentration ranges (all calculated as the corresponding metal):

| | | | |
|---|---|---|---|
| Mo | 1 to 500 mg/l | 10 to 250 mg/l | 20 to 150 mg/l |
| Cu | 1 to 1000 mg/l | 100 to 500 mg/l | 150 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 15 to 60 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |
| Ti | 20 to 500 mg/l | 50 to 300 mg/l | 50 to 150 mg/l |
| Zr | 20 to 500 mg/l | 50 to 300 mg/l | 50 to 150 mg/l |
| Hf | 20 to 500 mg/l | 50 to 300 mg/l | 50 to 150 mg/l |

The metal ions comprised in the after-rinse composition are deposited either in the form of a salt which comprises the corresponding metal cation (e.g., molybdenum or tin) preferably in at least two oxidation states—more particularly in the form of an oxyhydroxide, a hydroxide, a spinel or a defect spinel—or elementally on the surface that is to be treated (e.g., copper, silver, gold or palladium).

According to one preferred embodiment the metal ions are molybdenum ions. They are added preferably in the form of molybdate, more preferably of ammonium heptamolybdate and very preferably of ammonium heptamolybdate× $7H_2O$ to the after-rinse composition. The molybdenum ions may also be added in the form of sodium molybdate.

Molybdenum ions may alternatively be added, for example, in the form of at least one salt comprising molybdenum cations, such as molybdenum chloride, to the after-rinse composition, and then oxidized to molybdate by a suitable oxidizing agent, examples being the accelerators described earlier on above. In such a case, the after-rinse composition itself comprises a corresponding oxidizing agent.

With further preference the after-rinse composition comprises molybdenum ions in combination with copper ions, tin ions or zirconium ions.

With particular preference it comprises molybdenum ions in combination with zirconium ions and also, optionally, comprises a polymer or copolymer selected more particularly from the group consisting of the polymer classes of the polyamines, polyethyleneamines, polyanilines, polyimines, polyethyleneimines, polythiophenes and polypyrroles and also mixtures thereof and copolymers thereof and polyacrylic acid, with the content of molybdenum ions and zirconium ions in each case being in the range from 10 to 500 mg/l (calculated as the metal).

The content of molybdenum ions here is preferably in the range from 20 to 150 mg/l, more preferably from 25 to 100 mg/l and very preferably from 30 to 75 mg/l, and the content of zirconium ions is preferably in the range from 50 to 300 mg/l, more preferably from 50 to 150 mg/l.

According to a further preferred embodiment, the metal ions are copper ions. They are preferably in that case present in the after-rinse solution in a concentration of 100 to 500 mg/l, more preferably of 150 to 225 mg/l.

According to a further embodiment, the after-rinse composition of the invention comprises at least one polymer selected from the group consisting of the polymer classes of the polyamines, polyethyleneamines, polyanilines, polyimines, polyethyleneimines, polythiophenes and polypyrroles and also mixtures thereof and copolymers thereof.

The at least one polymer here is included preferably in a concentration in the range from 0.1 to 5 g/l, more preferably from 0.1 to 3 g/l, more preferably from 0.3 to 2 g/l and very preferably in the range from 0.5 to 1.5 g/l (calculated as the pure polymer).

Polymers used are preferably cationic polymers, especially polyamines, polyethyleneamines, polyimines and/or polyethyleneimines. Particularly preferred for use is a polyamine and/or polyimine, very preferably a polyamine.

According to a third embodiment, the after-rinse composition of the invention comprises at least one kind of metal ions selected from the group consisting of the ions of molybdenum, copper, silver, gold, palladium, tin, antimony, titanium, zirconium and hafnium and at least one polymer selected from the group consisting of the polymer classes of the polyamines, polyethyleneamines, polyanilines, polyimines, polyethyleneimines, polythiophenes and polypyrroles and also mixtures thereof and copolymers thereof, in each case in the following preferred, more preferred and very preferred concentration ranges (polymer calculated as the pure polymer, and metal ions calculated as the corresponding metal).

| | | | |
|---|---|---|---|
| Mo | 1 to 500 mg/l | 10 to 250 mg/l | 20 to 150 mg/l |
| Cu | 1 to 1000 mg/l | 100 to 500 mg/l | 150 to 225 mg/l |
| Ag | 1 to 500 mg/l | 5 to 300 mg/l | 20 to 150 mg/l |
| Au | 1 to 500 mg/l | 10 to 300 mg/l | 20 to 200 mg/l |
| Pd | 1 to 200 mg/l | 5 to 100 mg/l | 15 to 60 mg/l |
| Sn | 1 to 500 mg/l | 2 to 200 mg/l | 3 to 100 mg/l |
| Sb | 1 to 500 mg/l | 2 to 200 mg/l | 3 to 100 mg/l |
| Ti | 20 to 500 mg/l | 50 to 300 mg/l | 50 to 150 mg/l |
| Zr | 20 to 500 mg/l | 50 to 300 mg/l | 50 to 150 mg/l |
| Hf | 20 to 500 mg/l | 50 to 300 mg/l | 50 to 150 mg/l |
| Polymer | 0.1 g/l to 3 g/l | 0.3 g/l to 2 g/l | 0.5 to 1.5 g/l |

According to one preferred embodiment, the at least one polymer is a cationic polymer, more particularly a polyamine and/or polyimine, and the metal ions are copper ions, molybdenum ions and/or zirconium ions, in each case in the following preferred, more preferred and very preferred concentration ranges (polymer calculated as the pure polymer, and metal ions calculated as the corresponding metal).

| | | | |
|---|---|---|---|
| Mo | 1 to 500 mg/l | 10 to 250 mg/l | 20 to 150 mg/l |
| Cu | 1 to 1000 mg/l | 100 to 500 mg/l | 150 to 225 mg/l |
| Zr | 20 to 500 mg/l | 50 to 300 mg/l | 50 to 150 mg/l |
| Cat. polymer | 0.1 g/l to 3 g/l | 0.3 g/l to 2 g/l | 0.5 g/l to 1.5 g/l |

Particularly if the metallic surface is aluminum or an aluminum alloy, the after-rinse composition preferably further comprises 20 to 500 mg/l, more preferably 50 to 300 mg/l and very preferably 50 to 150 mg/l of Ti, Zr and/or Hf in complexed form (calculated as the metal). The complexes in question are preferably fluoro complexes. Moreover, the after-rinse composition comprises preferably 10 to 500 mg/l, more preferably 15 to 100 mg/l and very preferably 15 to 50 mg/l of free fluoride.

With particular preference the after-rinse composition comprises Zr in complexed form (calculated as the metal) and at least one kind of metal ions selected from the group consisting of the ions of molybdenum, copper, silver, gold, palladium, tin and antimony, preferably of molybdenum.

The pH of the after-rinse composition is preferably in the acidic range, more preferably in the range from 3 to 5, very preferably in the range from 3.5 to 5.

Surprisingly it has been found that lowering the pH promotes the deposition of molybdenum ions on the phosphate-coated metallic surface. In the case of an after-rinse solution comprising molybdenum ions, therefore, the pH is preferably 3.5 to 4.5 and more preferably 3.5 to 4.0.

The after-rinse composition is substantially nickel-free. It comprises preferably less than 0.1 g/l and more preferably less than 0.01 g/l of nickel ions.

The after-rinse composition preferably has a temperature in the range from 15 to 40° C. The metallic surface is treated with the after-rinse composition preferably for 10 to 180, more preferably for 20 to 150 and very preferably for 30 to 120 seconds, preferably by means of dipping or spraying.

Then, cathodically, an electrocoat material may be deposited on the phosphate-coated metallic surface—which has optionally also been treated with the after-rinse composition—and a coating system may be applied.

The metallic surface in this case, after the treatment with the after-rinse composition, is optionally first rinsed, preferably with fully demineralized water, and optionally dried.

The present invention additionally pertains to the above-described alkaline, aqueous cleaner composition which comprises at least one water-soluble silicate, and also to the concentrate, described at a corresponding point, from which this cleaner composition is obtainable.

The invention relates, moreover, to a phosphate-coated metallic surface which is obtainable with the method of the invention.

Lastly the invention also pertains to the use of the metallic surfaces coated with the method of the invention, in the sector of the automobile, automotive component supplier or general industry.

In the text below, the intention is to illustrate the present invention by means of working examples, which should be understood as imposing no restriction, and comparative examples.

EXAMPLES i) Production of Cleaning and Phosphating Baths:

The components were mixed in fully demineralized water, the pH was optionally adjusted with phosphoric acid (cleaning bath A), and the mixture was then diluted by a factor of 50 to 70, to produce the following cleaning baths:

| | Cleaning bath | | | | |
|---|---|---|---|---|---|
| | A | B | C | D | E |
| Component | Amounts (g/l) | | | | |
| Na waterglass | — | 2.6 | 2.6 | — | 2.4 |
| K waterglass | — | — | — | 3.1 | — |
| K pyrophosphate | 1 | 2 | 2 | — | — |
| Na tripolyphosphate | — | — | — | 0.5 | — |
| K tripolyphosphate | — | — | — | — | 0.8 |
| Phosphoric acid | — | — | — | — | 1.5 |
| Phosphonic acid | 0.1 | — | — | — | — |
| Na gluconate | — | — | 0.4 | — | — |
| Boric acid | — | — | — | — | 2.0 |

-continued

| Component | Cleaning bath A | B | C | D | E |
|---|---|---|---|---|---|
| | Amounts (g/l) | | | | |
| Na nitrite | — | — | 0.02 | — | — |
| KOH (90%) | 4.4 | 6 | 6 | 4.5 | 5.6 |
| pH adjustment | yes | no | no | no | no |
| pH | 10.5 | 11.6 | 11.6 | 11.2 | 11.3 |

Additionally, cleaning bath F and cleaning bath G were prepared. Cleaning bath F was identical to cleaning bath B apart from the pH of 10.5, while cleaning bath G was identical to cleaning bath E apart from the pH of 10.5. In the case both of cleaning bath F and of cleaning bath G, the pH was adjusted using phosphoric acid.

The components were mixed in fully demineralized water (zinc, nickel and manganese are added as nitrates and/or phosphates) and the A value was adjusted by lowering the Free Acid (FA) with sodium hydroxide, to produce the following nickel-free phosphating baths:

| Component | Phosphating bath A' | B' | C' |
|---|---|---|---|
| | Amounts (g/l) | | |
| Zn | 1.3 | 1.3 | 1.3 |
| Ni | 1 | 0 | 0 |
| Mn | 1.0 | 1.0 | 1.5 |
| Phosphate (calculated as $P_2O_5$) | 13 | 13.5 | 15 |
| Free fluoride | 0.08 | 0.08 | 0.07 |
| $BF_4^-$ | 1.0 | 1.0 | 1.0 |
| Nitrate | 3 | — | 0.05 |
| A Value | 0.08 | 0.06 | 0.07 |

$H_2ZrF_6$ and ammonium heptamolybdate were mixed in fully demineralized water and the pH was adjusted using dilute ammonia solution, to produce the following after-rinsing bath:

| Component | Amounts (mg/l) |
|---|---|
| Zr | 130 |
| Mo | 50 |
| pH | 4 |

ii) Treatment of Test Panels:

Test panels of hot-dip galvanized steel (EA), electrolytically galvanized steel (G) and also of the aluminum alloy AA 6014 (Al) were immersed for 300 seconds at 60° C. in one of cleaning baths A to D and thereafter for 30 seconds at 25° C. in an activating bath containing 0.6 g/l zinc phosphate. The test panels were then immersed for 180 seconds at 45° C. in one of phosphating baths A' to C' and thereafter for 30 seconds at 25° C. in the above-described after-rinsing bath. After thorough rinsing with fully demineralized water, the test panels were further coated with a cathodic electrocoat and also with a standard automotive coating system (filler, basecoat, clearcoat).

iii) Corrosion Protection and Coating Adhesion Tests:

The test plates pretreated and coated in this way were subsequently subjected to a DIN EN ISO 2409 cross-cut test. Tested in each case were 3 panels before and after exposure for 240 hours to condensation water (DIN EN ISO 6270-2 CH). The corresponding results (average values) are found in tab. 1. In these results, a cross-cut outcome of 0 is the best, an outcome of 5 being the poorest result. Results of 0 and 1 here are of comparable quality.

TABLE 1

| (Comp. -V) Ex. (B) | Subst. | Clean. | Phosph. | Cross-cut before exposure | after exposure |
|---|---|---|---|---|---|
| VB1 | EA | A | A' | 1.0 | 1.0 |
| VB2 | | A | B' | 3.3 | 5.0 |
| B1 | | C | B' | 1.0 | 3.0 |
| B6 | | B | C' | 0.7 | 0.3 |
| B7 | | F | C' | 0.7 | 0.7 |
| B8 | | E | C' | 0.7 | 0.7 |
| B9 | | G | C' | 0.3 | 1.7 |
| VB3 | | A | A' | 0.0 | 0.3 |
| VB4 | G | A | B' | 0.0 | 4.7 |
| B2 | | C | B' | 0.3 | 0.7 |
| VB5 | Al | A | A' | 0.0 | 0.0 |
| VB6 | | A | C' | 0.0 | 0.0 |
| B3 | | B | C' | 0.0 | 0.0 |

Furthermore, the test plates of electrolytically galvanized and hot-dip galvanized steel were subjected to a VDA test (VDA 621-415; 10 rounds), which determined the film undermining (U) in mm and also the film detachment after stone chipping (DIN EN ISO 20567-1, method C). A result of 0 is the best here, a result of 5 being the poorest after stone chipping has taken place. A result of up to 1.5 is considered good. The results (average values from three panels) are likewise summarized in tab. 2.

TABLE 2

| (Comp. - V) Ex. (B) | Subst. | Clean. | Phosph. | VDA U (mm) | Stone chipping |
|---|---|---|---|---|---|
| VB1 | EA | A | A' | 0.3 | 0.5 |
| VB2 | | A | B' | 3.0 | 1.5 |
| B1 | | C | B' | 0.8 | 1.0 |
| B4 | | B | C' | 1.1 | n.d. |
| B5 | | D | C' | 0.8 | n.d. |
| B6 | | B | C' | 0.9 | 1.5 |
| B7 | | F | C' | 1.5 | 2.0 |
| B8 | | E | C' | 2.1 | 1.5 |
| B9 | | G | C' | 2.4 | 1.5 |
| VB3 | G | A | A' | 0.6 | 0.7 |
| VB4 | | A | B' | 2.4 | 2.8 |
| B2 | | C | B' | 1.3 | 1.3 |

The test plates made of the aluminum alloy were, in contrast, subjected to a 240-hour CASS test in accordance with DIN EN ISO 9227 and also to a filiform test in accordance with DIN EN 3665. The results (average values from three panels) are summarized in tab. 3.

TABLE 3

| (Comp. - V) Ex. (B) | Subst. | Clean. | Phosph. | CASS | Filiform Mean | Max. |
|---|---|---|---|---|---|---|
| VB5 | Al | A | A' | 0.8 | 1.0 | 4.6 |
| VB6 | | A | C' | 0.9 | 1.8 | 8.7 |
| B3 | | B | C' | 0.5 | 0.9 | 6.9 |

iv) Results and Discussion:

The cross-cut results of tab. 1 show clearly the deterioration in coating adhesion in the case of the nickel-free rather than the nickel-containing phosphating on both hot-dip galvanized and electrolytically galvanized steel (cf. VB2 vs. VB1; VB4 vs. VB3). Through the use of a cleaning bath of the invention it is possible in the case of the nickel-free variant to achieve coating adhesion which corresponds almost to that of the nickel-containing variant (cf. B1 vs. VB1 and B2 vs. VB3).

Similar comments apply in respect of the results of tab. 2. Here as well, the use of a cleaning bath of the invention in the nickel-free phosphating achieves a significant improvement in the corrosion protection values. A further improvement comes about through the addition of gluconate and nitrite to the cleaning bath (cf. B1 vs. B4).

The CASS and filiform results in tab. 3 show that the use of a cleaning bath of the invention in nickel-free phosphating on the aluminum alloy produces a significant improvement in the corrosion protection values (cf. B3 vs. VB5 and VB6). In the case of CASS and also filiform, mean, the corrosion protection achieved is in fact better than for the nickel-containing variant.

The comparison of examples B6 and B7 (cf. tab. 1 and also tab. 2) indicates in each case the further improvement in the results achieved, through the choice of a pH of 11.6 (B6) instead of a pH of 10.5 (B7).

The comparison of examples B8 and B9 (cf. tab. 1 and also tab. 2) indicates in each case the further improvement in the results achieved, through the choice of a pH of 11.3 (B8) instead of a pH of 10.5 (B9).

The invention claimed is:

1. A method for substantially nickel-free phosphating of a metallic surface, which comprises treating a metallic surface one after the other with the following compositions:

i) with an alkaline, aqueous cleaner composition which comprises at least one water-soluble silicate, the at least one water-soluble silicate comprising at least one waterglass and/or at least one metasilicate, the at least one water-soluble silicate being present in a total concentration in the range from 0.01 to 15 g/l, the at least one water-soluble silicate having a water-solubility of at least 1 mg/l in deionized water at 25° C., the pH of the cleaner composition being in the range from 10.7 to 12.0, and then ii) with an acidic, aqueous, substantially nickel-free phosphating composition which comprises zinc ions, manganese ions and phosphate ions and less than 0.01 g/l nickel ions; and iii) with an aqueous after-rinse composition after treating the metallic surface with the phosphating composition, the after-rinse composition comprising molybdenum ions and zirconium ions.

2. The method according to claim 1, wherein the metallic surface is at least partly galvanized.

3. The method according to claim 1, wherein the at least one water-soluble silicate comprises at least one sodium waterglass and/or potassium waterglass.

4. The method according to claim 1, wherein the cleaner composition comprises at least one phosphorus-containing complexing agent and/or at least one hydroxycarboxylic acid or salt thereof.

5. The method according to claim 4, wherein the at least one phosphorus-containing complexing agent comprises a pyrophosphate and/or tripolyphosphate.

6. The method according to claim 4, wherein the at least one hydroxycarboxylic acid or salt thereof comprises gluconate.

7. The method according to claim 1, wherein the cleaner composition comprises nitrite.

8. An alkaline, aqueous cleaner composition which comprises at least one water-soluble silicate, according to claim 1.

9. A concentrate from which a cleaner composition according to claim 8 is obtainable by dilution with a suitable solvent and, where necessary, addition of a pH-modifying substance.

10. A phosphate-coated metallic surface which is obtainable by the method according to claim 1.

11. The use of the metallic surface according to claim 10 in the sector of the automobile, automotive component supplier or general industry.

12. The method according to claim 1, wherein the pH of the cleaner composition is in the range from 11.0 to 12.0.

13. The method according to claim 12, wherein the pH of the cleaner composition is in the range from 11.3 to 12.0.

14. The method according to claim 13, wherein the pH of the cleaner composition is in the range from 11.5 to 12.0.

15. The method according to claim 1, wherein the at least one water-soluble silicate is present in a total concentration in the range from 0.2 to 13 g/l.

16. The method according to claim 15, wherein the at least one water-soluble silicate is present in a total concentration in the range from 0.5 to 10 g/l.

* * * * *